US009865950B2

(12) United States Patent
Dandl et al.

(10) Patent No.: US 9,865,950 B2
(45) **Date of Patent: *Jan. 9, 2018**

(54) PLUG CONNECTOR ASSEMBLY

(71) Applicant: Rosenberger Hochfrequenztechnik GmbH & Co. KG, Fridolfing (DE)

(72) Inventors: Christian Dandl, Fridolfing (DE); Thomas Höfling, Grabenstätt (DE); Christian Biermann, Salzburg (AT); Thomas Schmid, Teisendorf (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/376,937

(22) Filed: Dec. 13, 2016

(65) Prior Publication Data

US 2017/0162956 A1 Jun. 8, 2017

Related U.S. Application Data

(63) Continuation of application No. 14/427,183, filed as application No. PCT/EP2013/002701 on Sep. 9, 2013, now Pat. No. 9,543,718.

(30) Foreign Application Priority Data

Sep. 18, 2012 (DE) ..... 20 2012 008 969

(51) Int. Cl.

| | |
|---|---|
| ***H01R 12/73*** | (2011.01) |
| ***H01R 13/6473*** | (2011.01) |
| ***H01R 13/11*** | (2006.01) |
| ***H01R 13/6471*** | (2011.01) |
| ***H01R 13/6585*** | (2011.01) |
| ***H01R 24/60*** | (2011.01) |

(Continued)

(52) U.S. Cl.
CPC ..... *H01R 12/73* (2013.01); *H01R 13/112* (2013.01); *H01R 13/113* (2013.01);
(Continued)

(58) Field of Classification Search
CPC .... H01R 12/73; H01R 13/112; H01R 13/113; H01R 13/6471; H01R 13/6473;
(Continued)

(56) References Cited

U.S. PATENT DOCUMENTS

| | | | |
|---|---|---|---|
| 4,552,425 | A | 11/1985 | Billman |
| 5,160,273 | A | 11/1992 | Carney |

(Continued)

FOREIGN PATENT DOCUMENTS

| | | | |
|---|---|---|---|
| CN | 1213522 | C | 8/2005 |
| CN | 101563815 | A | 10/2009 |

(Continued)

*Primary Examiner* — Harshad C Patel
(74) *Attorney, Agent, or Firm* — DeLio, Peterson & Curcio, LLC; Robert Curcio

(57) ABSTRACT

A plug connector assembly having a first plug connector and a second plug connector, wherein the plug connectors each have at least two contact elements, wherein the contact elements of the first plug connector make contact with the contact elements of the second plug connector at contact points in the plug-connected state of the plug connector assembly, such that the contact elements of the two plug connectors are designed in the form of contact lugs which project into a free space and can be elastically deflected.

6 Claims, 4 Drawing Sheets

(51) Int. Cl.
*H01R 24/66* (2011.01)
*H01R 24/76* (2011.01)
*H01R 107/00* (2006.01)

(52) U.S. Cl.
CPC ..... *H01R 13/6471* (2013.01); *H01R 13/6473* (2013.01); *H01R 13/6585* (2013.01); *H01R 24/60* (2013.01); *H01R 24/66* (2013.01); *H01R 24/76* (2013.01); *H01R 2107/00* (2013.01)

(58) Field of Classification Search
CPC ..... H01R 1313/6585; H01R 33/76; H01R 23/02; H01R 13/10; H01R 33/00
USPC ..... 439/682, 295, 393, 284
See application file for complete search history.

(56) References Cited

U.S. PATENT DOCUMENTS 5,169,324 A * 12/1992 Lemke ..... H01R 13/187 439/101
5,620,340 A 4/1997 Andrews
5,888,096 A 3/1999 Soes
5,906,518 A * 5/1999 Sun ..... H01R 13/193 439/295
6,471,523 B1 10/2002 Shuey
6,478,624 B2 11/2002 Ramey et al.
7,314,377 B2 * 1/2008 Northey ..... H01R 12/777 439/79
7,726,982 B2 6/2010 Ngo
2006/0003620 A1 * 1/2006 Daily ..... H01R 13/113 439/295
2009/0017652 A1 * 1/2009 Stoner ..... H01R 13/112 439/92
2009/0149040 A1 6/2009 Yazawa
2012/0015563 A1 1/2012 Szczesny

FOREIGN PATENT DOCUMENTS

CN 101882718 A 11/2010
DE 4446098 A1 9/1996
DE 60110070 T2 5/2006
FR 2929047 A1 9/2009
JP H07122335 A 5/1995
JP 2003512706 A 4/2003
WO 2008054683 A1 5/2008

* cited by examiner

PLUG CONNECTOR ASSEMBLY

BACKGROUND OF THE INVENTION

1. Field of the Invention

The invention relates to a plug connector assembly with a first and a second plug connector. In particular, the invention relates to a multiple plug connection for the electrically conductive connection of two circuit boards for the transmission of radio frequency signals.

2. Description of Related Art

Circuit board plug connector assemblies should ensure, as far as possible, loss-free transmission of radio frequency signals, within a defined tolerance range in terms of the parallel alignment and the spacing between the two circuit boards. Other requirements of such contact elements include economic, manufacture, and simple assembly.

It is known for a simple connection (i.e., forming a radio frequency signal path) between two circuit boards to be established by two coaxial plug connectors firmly connected with the circuit boards and an adapter connecting both coaxial plug connector assemblies, the so-called "bullet". This adapter makes possible an axial and radial tolerance compensation, as well as the compensation of tolerances in terms of parallel alignment. Typical coaxial plug connectors used for this purpose are sub-miniature push-on connectors (SMP), Mini-SMP, or a connector for field-programmable gate array (FMC).

Alternatively, electrical connections between two circuit boards are also realized via spring-loaded contact pins, so-called "pogo pins", in single-conductor or multiple-conductor configurations. Such spring-loaded contact pins comprise a sleeve and a head guided partially within the sleeve as well as a helical spring supported between the head and the sleeve. The properties required of the helical spring in terms of spring force and block length demand relatively long spring lengths, which have a corresponding effect on the axial construction height of the spring-loaded contact pins. In addition, the use of spring-loaded contact pins in the single-conductor configuration requires that these need to be arranged in a particular pattern as signal and ground pins in order to achieve a satisfactory electrical output. On the other hand, because of their complicated structure, multiple conductors are susceptible to faults and are expensive.

SUMMARY OF THE INVENTION

Bearing in mind the problems and deficiencies of the prior art, it is therefore an object of the present invention to provide a plug connector assembly with two plug connectors where the contact elements of the two plug connectors are designed in the form of contact lugs which project into a free space and can be elastically deflected.

It is another object of the present invention to provide an improved plug connector assembly where the contact elements of the plug connectors are designed in the form of elastically deflectable contact lugs projecting into free space.

The above and other objects, which will be apparent to those skilled in the art, are achieved in the present invention which is directed to a plug connection comprising a first plug connector and a second plug connector, wherein the plug connectors each have at least two contact elements, wherein the contact elements of the first plug connector make contact with the contact elements of the second plug connector at contact points in a plug-connected state of the plug connector assembly, wherein the contact elements of the two plug connectors form contact lugs which project into free space and can be elastically deflected, of which a first contact lug of each contact element is part of an inner conductor and a second contact lug of each contact element is part of an outer conductor enclosing the inner conductor in a coaxial arrangement, wherein the contact lugs of the second plug connector are each contacted by several spring-loaded contact lugs of the first plug connector in a pincer-like manner.

The contact lugs of the inner conductor may in each case be enclosed by the contact lugs of the outer conductor, and may be stamped or stamped and bent components.

The plug connector assembly may include insulating bodies arranged in each case between the outer conductors and inner conductors of the plug connector.

The cross sections of the contact lugs formed by the inner conductors are larger than the cross sections of the sections of the inner conductor enclosed by the insulating bodies such that a substantially constant impedance results.

The first plug connector and/or the second plug connector may possess a plurality of inner/outer conductor pairs, wherein the insulating body extends both between the inner conductor and outer conductor of the inner/outer conductor pairs as well as between the inner/outer conductor pairs themselves, and wherein the insulating body of at least one of the plug connectors forms a housing enclosing the contact lugs.

The inner conductor and the outer conductor of at least one of the plug connectors may form, at their ends opposite the contact lugs, contact regions for making contact with a circuit board.

The insulating body of at least one plug connector may form a fastener for connection with a circuit board.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
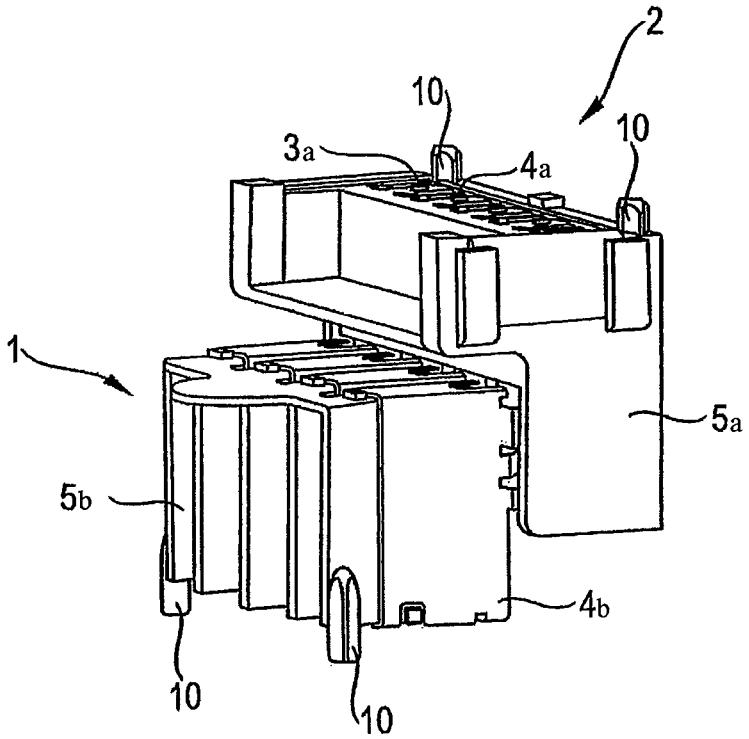
FIG. 1 shows a perspective view of a plug connector assembly according to the invention in its plug-connected state.
Figure 2:
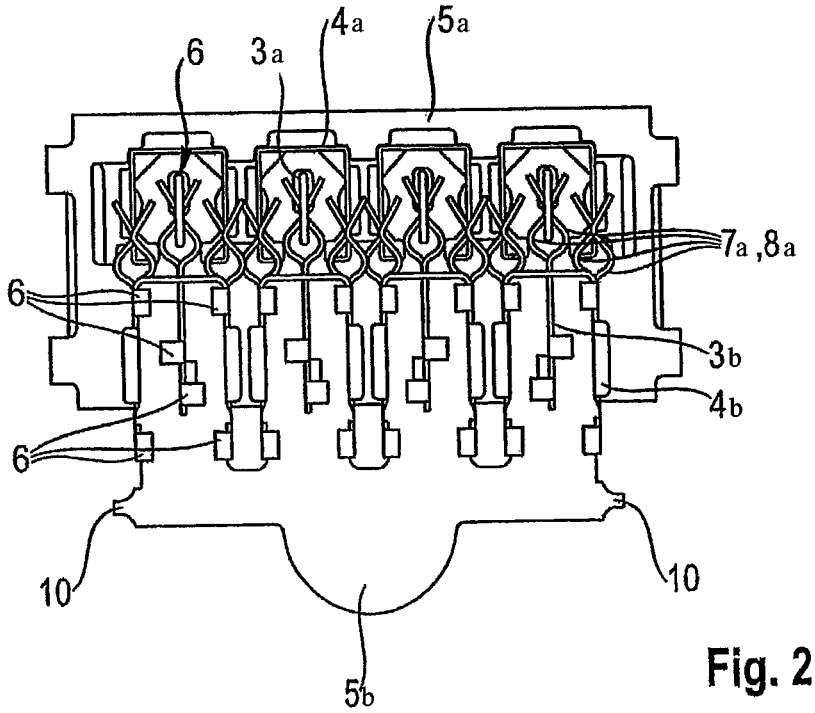
FIG. 2 shows a view from below of the plug connector assembly according to FIG. 1.
Figure 3:
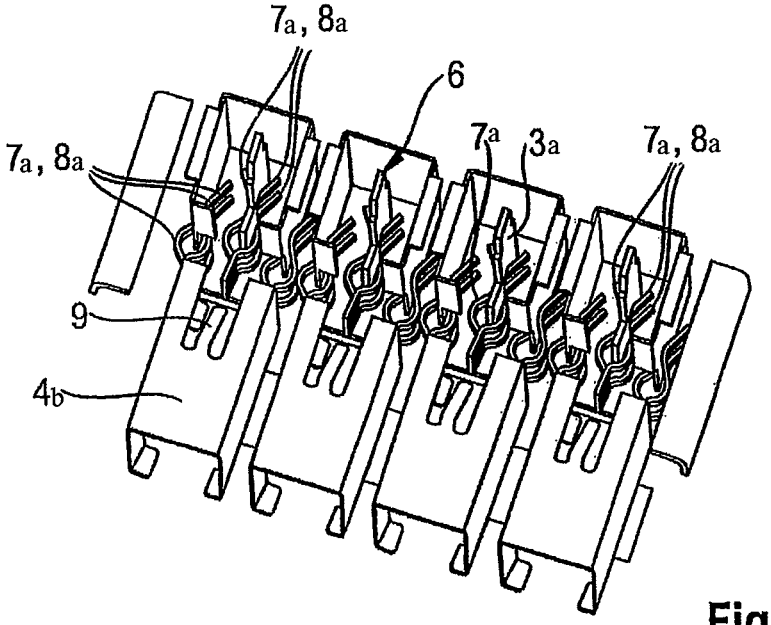
FIG. 3 shows an isolated perspective view of the conductor components of the plug connector assembly according to FIGS. 1 and 2.
Figure 4:
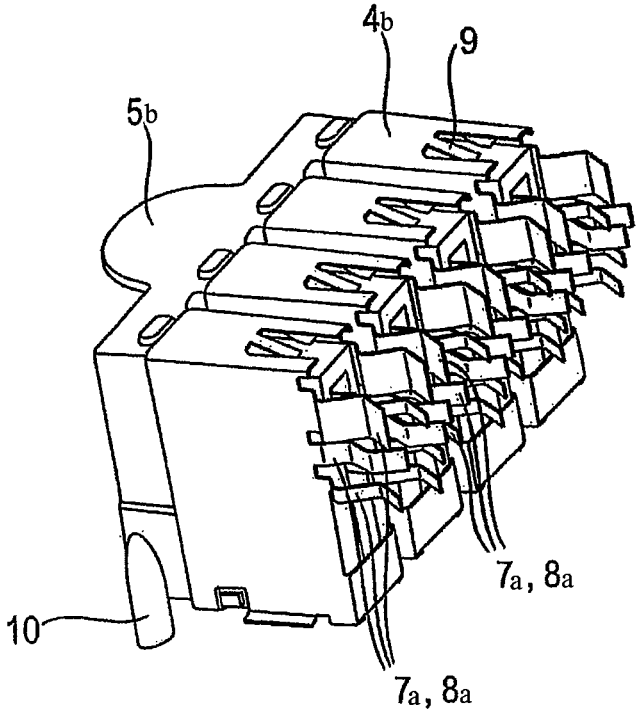
FIG. 4 shows a perspective view of the first plug connector of the plug connector assembly.
Figure 5:
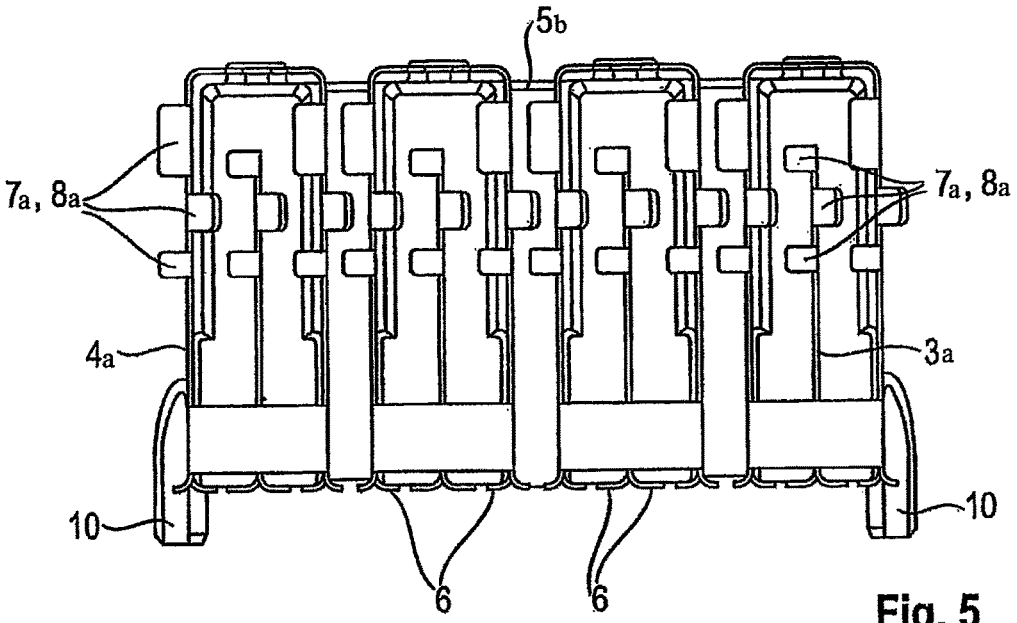
FIG. 5 shows a frontal view of the first plug connector of the plug connector assembly.
Figure 6:
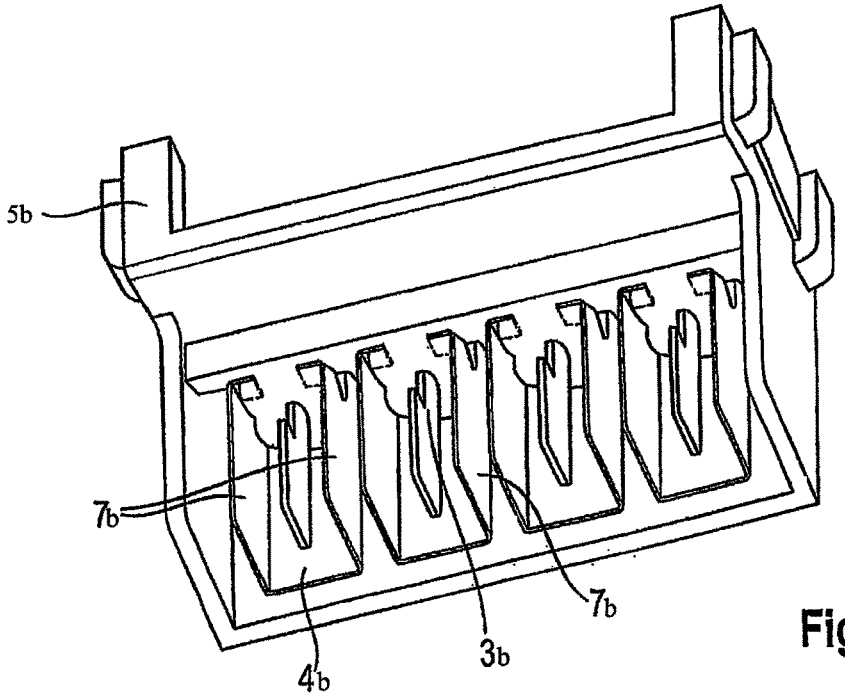
FIG. 6 shows a first perspective view of the second plug connector of the plug connector assembly.
Figure 7:
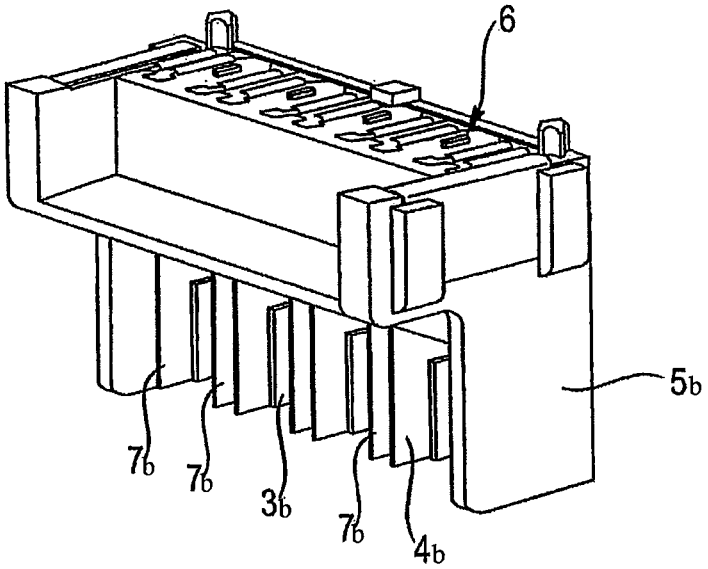
FIG. 7 shows a second perspective view of the second plug connector of the plug connector assembly.

In describing the preferred embodiment of the present invention, reference will be made herein to FIGS. 1-7 of the drawings in which like numerals refer to like features of the invention.

Starting out from this prior art, the invention was based on the problem of providing an improved plug connector assembly. In particular, despite having tolerance-compensating properties, the plug connector assembly should be distinguished through economical, manufacture, and/or a simple structure or simple assembly.

This problem is solved through the subject matter of the claims. Advantageous embodiments of the plug connector assembly according to the invention are explained in the following description of the invention.

A plug connector assembly of this generic type, which comprises at least one first plug connector and a second plug connector, wherein the plug connectors each possess at least two contact elements and wherein the contact elements of the first plug connector make contact with the contact elements of the second plug connector at contact points in the plug-connected state of the plug connector assembly, is developed further according to the invention in that the contact elements of both plug connectors are designed in the form of elastically deflectable contact lugs projecting into free space (and preferably completely freely into space).

Despite its simple structure, this embodiment allows a compensation of even comparatively large tolerances, since both sides of the contact, i.e. the contact elements of one plug connector and the contact elements of the other plug connector, can—insofar as necessary—contribute to the tolerance compensation through the possibility of elastic deflection.

According to the invention, "contact lug" is understood to mean a contact element which extends, from a connection point at which this is firmly connected with another component, in its longitudinal direction into an (at least partially, preferably completely) free space, whereby, on pressure being applied in a direction transverse to the longitudinal direction, the contact element is deflected elastically, thus providing a functional, tolerance-compensating resilient effect. Preferably, such a contact lug according to the invention is planar in construction form (with a height which only amounts to a fraction of the width and length, wherein the width is also preferably less than the length).

The plug connector assembly according to the invention is preferably intended for the transmission of radio frequency signals. In particular, for this application the contact lugs of each plug connector can, advantageously, be arranged in the form of coaxial contact element pairs, i.e., a first contact lug is in each case part of an inner conductor of the corresponding plug connector and a second contact lug is in each case part of an outer conductor of the corresponding plug connector enclosing the inner conductor. Particularly preferably, it can also be the case that the contact lugs of the inner conductor are in each case enclosed by the contact lugs of the outer conductor. This embodiment allows the inner conductor serving as a signal conductor to be shielded against electromagnetic interference by the outer conductor, even in the region of the contact lugs, and furthermore, in a preferred embodiment of the plug connector assembly as a multiple plug connection, crosstalk between the contact element pairs is minimized.

In a further preferred embodiment of the plug connector assembly according to the invention, the contact lugs of the first plug connector can be designed as spring-loaded contact lugs.

According to the invention, "spring-loaded contact lugs" are understood to be contact lugs in which an elastic deflection takes place not only for the purpose of allowing a tolerance compensation but also when making contact with the corresponding counter contact element. Accordingly, one function of the spring-loaded contact lugs is also to provide sufficient contact pressure at the contact points through an elastic restoring force.

In order to achieve a particularly good and secure contact between the contact elements of the two plug connectors, even with very large tolerances, it can also be the case that double contact lugs of one plug connector grasp single contact lugs of the other plug connector in a pincer-like manner. Particularly preferably, the double contact lugs are thereby designed in the form of spring-loaded contact lugs.

A simple and thus economical possibility for creating a plug connector assembly according to the invention involves designing the contact lugs and in particular the entire inner and outer conductors in the form of stamped and bent components.

In a further preferred embodiment of the plug connector assembly according to the invention, insulating bodies can in each case be arranged between the outer conductors and inner conductors of the plug connectors. These insulating bodies can thereby not only have an insulating function but can also contribute to the stability of the plug connectors and, particularly preferably, form a housing for one or both plug connectors at least partially enclosing the inner and outer conductors (and preferably also the contact elements). The housing can thereby also be part of the plug interface which, for example, guides the plugging-together movement of the plug connector, only permitting such movement if the plug connectors are correctly aligned with one another and/or effecting a mechanical fixing of the plug connectors in their plug-connected state.

In order to achieve a low-reflection transmission of radio frequency signals by means of the plug connector assembly according to the invention, changes in impedance in the signal conductor should be avoided. Since the impedance is largely influenced by the signal conductor (material and cross section, in particular size of cross section) as well as by the dielectric surrounding this, in a further preferred embodiment the cross sections of the contact lugs formed by the inner conductors are selected so as to be different from the cross sections of the sections of the inner conductor enclosed by the insulating bodies such that a substantially constant impedance results. As a rule, the cross sectional surface area of the contact lugs, which are usually surrounded by air as a dielectric, is designed to be greater than the cross sectional surface area of the sections of the inner conductor enclosed by the insulating bodies.

The embodiment according to the invention allows, in an advantageous manner, the formation of a multiple plug connection in which the first plug connector and the second plug connector possess a plurality of inner/outer conductor pairs. In such a multiple plug connector assembly, it can then also advantageously be the case that the insulating body, preferably formed as a single part, extends both between the inner conductor and outer conductor of the inner/outer conductor pairs and also between the inner/outer conductor pairs themselves. In a particularly preferable embodiment, one or both of the multiple plug connectors can thus be formed of a single one-piece insulating body with inner and outer conductors arranged or fixed therein. Such a multiple plug connector can be particularly economical to manufacture and assemble.

The plug connector assembly according to the invention is, advantageously, suitable for the connection of two circuit boards, i.e. as a so-called Board-to-Board or B2B connection. For this purpose, the inner conductor(s) and/or the outer conductor(s) of at least one plug connector, preferably both plug connectors, can, at their ends opposite the contact lugs, form contact regions for making contact with conductive traces of a circuit board. These contact regions can preferably be designed in the form of curved or angled sections of the inner and/or outer conductors.

Also preferably, it can then also be the case that the insulating body forms a connection with a circuit board. This connection can for example be designed in the form of snap-in tabs.

The plug connector assembly shown in FIGS. 1 to 7 comprises a first plug connector 1 and a second plug connector 2. Each of the plug connectors 1, 2 comprises a plurality of (specifically, four) conductor pairs, consisting in each case of inner conductor 3*a*, 3*b* and outer conductor 4*a*, 4*b*, which are arranged in a coaxial configuration. The inner conductor 3*a*, 3*b* and outer conductor 4*a*, 4*b* of the plug connectors 1, 2 are in each case held in or on a respective insulating body 5*a*, 5*b*, which not only electrically insulates the inner conductor 3*a*, 3*b* from the outer conductor 4*a*, 4*b* of the individual conductor pairs, but also insulates the conductor pairs from each other, fixes all the conductors mechanically and in addition forms a housing with a fastener which makes it possible in each case to attach the plug connectors 1, 2 to a circuit board (not shown).

All conductors are manufactured as stamped or stamped and bent components, i.e., they are stamped out of an electrically conductive metal sheet and then formed into shape if necessary, which makes economical mass production possible. All conductors also have sections in which these, at least on one side, adjoin the associated insulating bodies 5*a*, 5*b* and are largely immovable in relation to these. All conductors also form contact regions 6 which are provided to make contact with an associated contact region on the corresponding circuit board. In addition, the conductors form contact lugs 7*a*, 7*b* which form contact points for making contact with the relevant (matching) contact lugs 7*a*, 7*b* of the other plug connectors 1, 2.

The inner conductors 3*b* of the second plug connector 2 are designed as simple stamped components, and thus have a particularly simple geometry. These form flat contact lugs 7*b* with relatively large lateral contact surfaces which project into a free space. Contact regions 6 for contacting the corresponding circuit board are provided on the end faces opposite the contact lugs 7*b*. The contact lugs 7*b* of the second plug connectors 2 are in each case contacted in a pincer-like manner by several (specifically, three) spring-loaded contact lugs 8*a*, of the first plug connector 1. The spring-loaded contact lugs 8*a*, are S-shaped in form. This allows a relatively large spring displacement, i.e., a deflectability in a lateral direction, to be achieved. In addition, a V-formed intake is formed between the three spring-loaded contact lugs 8*a*, of an inner conductor 3*a*, which ensures the pincer-like grasping of the relevant contact lug 7*b* of the second plug connector 2, also with relatively large positioning tolerances. The S-shaped form also forms relatively small-surface-area contact points of the spring-loaded contact lugs 8*b*. The sections of the inner conductors 3*b* located within the insulating body 5*b* of the first plug connector 1 extend flat and terminate on the lower side in two contact regions 6, angled at approximately 90°, by means of which a contact is made with the associated circuit board.

The outer conductors 4 of both plug connectors 1, 2 are housing-formed, as a result of which they enclose the corresponding inner conductor 3*a*, 3*b* and, by enclosing sections of the insulating body 5*a*, 5*b*, are mechanically connected with this.

The outer conductors 4*b* of the second plug connector 2 project, with a three-sided housing section, freely into space, wherein the two opposite sides serve as contact lugs 7*b* which—as in the case of the inner conductors 3*b*—are contacted in a pincer-like manner by several (specifically, three) S-formed spring-loaded contact lugs 8*a* of the first plug connector 1.

All contact lugs 7*a*, 7*b* of the two plug connectors 1, 2 are relatively long in design or designed with a large surface area, as a result of which—despite being sufficiently strong and thus able to withstand loads—they can be deflected relatively far under the forces which occur when plugging together the plug connectors 1, 2. This relatively high deflectability is further enhanced through the particular embodiment of the plug connection whereby all the contact elements are designed to be elastically deflectable. This flexibility allows the tolerance requirements for the plug connectors 1, 2 to be kept low, which in turn simplify their manufacture.

At the same time, the pincer-like contacting of the contact lugs 7*b* formed by the inner conductors 3*b* of the second plug connector 2 by the spring-loaded contact lugs 8*a* of the first plug connector 1 always guarantees a sufficient contact pressure on at least some of the spring-loaded contact lugs 8*a* and thus a reliable transmission of the radio frequency signals, also with very large tolerances.

This particular embodiment of the plug connector assembly also makes it possible to compensate relatively large tolerances in the direction of the longitudinal axes of the inner conductor 3*b* of the second plug connector 2, since the lateral contact surfaces of the contact lugs 7*b* formed by this are so large that these can be contacted by the spring-loaded contact lugs 8*a* of the first plug connector within a correspondingly wide tolerance range.

The insulating bodies 5*a*, 5*b* of both plug connectors 1, 2 are manufactured as a single piece of plastic. These are also so formed that they can be ejected from a two-part mold. Undercuts in the direction of ejection from the mold (this corresponds to the longitudinal direction of the inner conductor 3*b* of the second plug connector 2) are completely or largely avoided. Injection molding of the insulating bodies 5*a*, 5*b* is thus possible without major complication. This method of manufacture, like the stamping or stamping and bending of all conductors, makes possible a particularly economical mass series production of all components of the plug connector assembly.

In addition, assembly is also very simple and in particular can be automated. For this purpose, the already largely pre-formed inner conductors 3*b* as well as the outer conductors 4*b* of the second plug connector 2 simply need to be pushed into the corresponding through-openings in the insulating bodies 5*a*, 5*b* and then fixed in place. In the case of the inner conductors 3*a* of the first plug connector 1 and the outer conductors 4*b* of the second plug connector 2, the contact regions 6 are bent over for this purpose. In the case of the inner conductors 3*b* of the second plug connector 2 the fixing is effected through material engagement by adhesive bonding. Naturally, however, fixing by friction-locking or form-locking components, for example through snap-locking elements, is also possible. The outer conductors 4*a* of the first plug connector 1 are then pushed onto the corresponding sections of the insulating body 5*a*, and fixed in place by bending locking tabs 9 which then engage in recesses in the insulating body 5*a*.

Naturally, instead of or in addition to the form-locking fixing by bending tabs, fixing can be effected through material engagement (e.g. through adhesive bonding) or by force-locking. A form-locking fixing snap-locking elements can also be provided.

For the purpose of mechanical connection of the plug connector 1, 2 with the corresponding circuit boards, both insulating bodies 5*a*, 5*b* possess attachment pins 10 which are pushed through corresponding through-openings in the circuit boards and fixed in place through plastic deformation of their free ends.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

The invention claimed is:

1. A plug connection comprising a first plug connector and a second plug connector, wherein the plug connectors each have at least two contact elements, wherein the contact elements of the first plug connector make contact with the contact elements of the second plug connector at contact points in a plug-connected state of the plug connection, wherein the contact elements of the two plug connectors form contact lugs which project into free space and can be elastically deflected, of which a first contact lug of each contact element is part of an inner conductor and a second contact lug of each contact element is part of an outer conductor enclosing the inner conductor in a coaxial arrangement, and wherein the cross sectional surface area of the contact lugs surrounded by a dielectric, is greater than the cross sectional surface area of the sections of the inner conductor enclosed by insulating bodies, such that a substantially constant impedance results.

2. The plug connection of claim 1, wherein the contact lugs of the inner conductor are in each case enclosed by the contact lugs of the outer conductor, and wherein the contact lugs of the second plug connector are each contacted by several spring-loaded contact lugs of the first plug connector in a pincer-like manner.

3. The plug connection of claim 1, wherein said insulating bodies arranged in each case between the outer conductors and inner conductors of the plug connector.

4. The plug connection of claim 1, wherein the first plug connector and/or the second plug connector possesses a plurality of inner/outer conductor pairs, wherein the insulating body extends both between the inner conductor and outer conductor of the inner/outer conductor pairs as well as between the inner/outer conductor pairs themselves.

5. The plug connection of claim 1, wherein the insulating body of at least one of the plug connectors forms a housing enclosing the contact lugs.

6. The plug connection of claim 1, wherein the insulating body of at least one plug connector forms a fastener for connection with a circuit board.

* * * * *